US005178799A

United States Patent [19]

Brown et al.

[11] Patent Number: 5,178,799

[45] Date of Patent: Jan. 12, 1993

[54] CARBONATED BEVERAGE DISPENSING APPARATUS

[75] Inventors: John Brown, Wilton; Allen L. Rogala, Torrington, both of Conn.

[73] Assignee: Wilshire Partners, Cleveland, Ohio

[21] Appl. No.: 850,144

[22] Filed: Mar. 12, 1992

Related U.S. Application Data

[63] Continuation of Ser. No. 638,125, Jan. 7, 1991, abandoned.

[51] Int. Cl.[5] ..... B01F 5/00; B01F 3/04

[52] U.S. Cl. ..... 261/39.1; 261/DIG. 7; 137/505.14

[58] Field of Search ..... 261/39.1, DIG. 7; 137/505.14, 505.42

[56] References Cited

U.S. PATENT DOCUMENTS

| | | | |
|---|---|---|---|
| 1,236,953 | 4/1917 | Lewis | 137/505.14 |
| 2,199,661 | 5/1940 | Gamble et al. | 261/39.1 |
| 2,514,463 | 7/1950 | Bayers, Jr. | 261/39.1 |
| 2,741,263 | 4/1956 | Spencer | 137/505.14 |
| 3,552,726 | 1/1971 | Kraft | 261/DIG. 7 |
| 3,794,302 | 2/1974 | Diener | 261/39.1 |
| 4,265,270 | 5/1981 | Satoh | 137/505.14 |
| 4,287,909 | 9/1981 | Thompson et al. | 137/505.14 |
| 4,632,275 | 12/1986 | Parks | 261/DIG. 7 |
| 4,745,904 | 5/1988 | Cagle | 137/495 |

*Primary Examiner*—Tim Miles

*Attorney, Agent, or Firm*—Body, Vickers & Daniels

[57] ABSTRACT

In a carbonated beverage dispensing apparatus including a dispensing valve, carbon dioxide gas is introduced into a liquid to be dispensed through the dispensing valve, and a temperature sensor is arranged to sense the temperature of the liquid, either in a carbonation tank or in the path through which the liquid is fed to the carbonation tank. A control, responsive to the temperature sensor, controls a valve which regulates the pressure at which carbon dioxide is introduced into the liquid. The carbon dioxide pressure increases with increasing liquid temperature, so that the carbonation level in the liquid dispensed through the dispensing valve is maintained at a substantially constant level. Both mechanical and electronic controls are disclosed.

11 Claims, 9 Drawing Sheets

CARBONATED BEVERAGE DISPENSING APPARATUS

This is a continuation of Ser. No. 638,125 filed Jan. 7, 1991, now abandoned.

BRIEF SUMMARY OF THE INVENTION

This invention relates generally to carbonators, and in particular to a carbonator apparatus utilized in a post-mix beverage dispensing system. It relates particularly to a carbonator in which the level of carbonation is controlled in such a way as to avoid various problems which result from excessive carbonation.

The solution of carbon dioxide gas into water is enhanced at colder temperatures and higher pressures. Gas pressure is not difficult to regulate. However, the ambient temperature, and the temperature of the water supply in a carbonating apparatus tend to vary. Because of these temperature variations, control of the temperature of the water supplied to a carbonating apparatus has been difficult in commercial carbonating equipment, and in many instances economically infeasible, particularly in the carbonators of post-mix beverage dispensers. Consequently the $CO_2$ content of dispensed beverages has been difficult to control.

Hitherto, the accepted practice was to set the pressure of $CO_2$ entering the carbonating chamber at a level high enough to achieve adequate levels of carbonation at the highest normally anticipated water temperature. Reduced water supply temperature due to daily, seasonal, or geographical trends, causes excessive levels of carbonation to be produced, giving rise to various undesirable conditions described below.

One of the problems resulting from the inability to control water supply temperature is $CO_2$ wastage due to out-gassing of excess carbonation at the point of release to atmospheric pressure (usually at the beverage mixing dispensing valve output).

Another problem is that excessive levels of carbonation at the point of dispensing cause irregular and inconsistent operation of the fluid flow controls. Furthermore, excessive carbonation levels at the point of dispensing causes the inconvenience of high foam levels in the beverage receptacle, and product wastage due to overflow and repeated topping-off cycles. The undesirable results of excessive carbonation levels in beverage dispensing equipment are exacerbated with faster beverage dispensing rates, as found in modern beverage dispensing equipment.

It is the principal object of the present invention, therefore, to provide an apparatus to control carbonation level over a widely varying range of temperatures in the water used in the carbonation process.

It is a further object of the invention to provide an improved apparatus for effecting carbonation of water in post-mix beverage dispensers and in other equipment requiring carbonated water at controlled $CO_2$ levels.

It is yet another object of this invention to conserve carbon dioxide, and thereby reduce operating costs, by limiting carbonation level to a predetermined range, and to eliminate $CO_2$ wastage due to out-gassing at the point of release to atmospheric pressure.

Among other objects of the invention are the improvement of the performance of beverage dispensing equipment, and especially the beverage mixing valve, and the avoidance of such problems as inconsistent operation of the fluid flow controls, high foam levels in the beverage receptacle, and product wastage.

These and other objects of the invention are addressed in accordance with the invention by providing a control system in which a temperature sensor is arranged to sense the temperature of the water, and control means, responsive to the temperature sensing means control the pressure at which carbon dioxide is introduced into the water, the pressure increasing with increasing water temperature. The relationship between water temperature and $CO_2$ pressure, as determined by the control means, is preferably such that the carbonation level in the dispensed carbonated beverage is maintained within a limited range, and preferably at a substantially constant level.

The temperature sensor senses the temperature of the supply water being provided to the carbonator tank, or of the carbonated water within the tank itself. The $CO_2$ pressure can be controlled by a temperature sensing gas regulator, or an electronically controlled regulator responsive to a temperature transducer. The desired carbonation level or range of carbonation levels can be selected, and with the apparatus set for the desired carbonation level, the level will be automatically maintained even though the temperature of the water supplied to or within the carbonator tank may vary.

DETAILED DESCRIPTION

Figure 1:
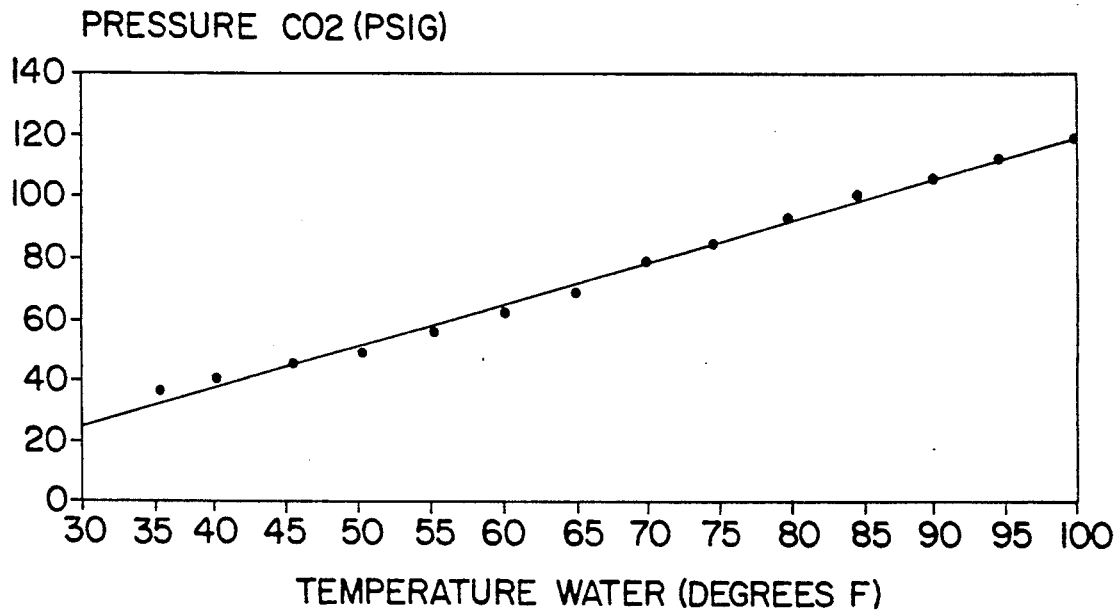
FIG. 1 is a diagram showing the relationship between $CO_2$ pressure and water temperature for a specific carbonation level.

Carbonation level in soft drink dispensing is defined in terms of the ratio of the volume of carbon dioxide to the volume of water. As shown in FIG. 1, as temperature increases, it is necessary to increase $CO_2$ pressure to maintain a given carbonation level. Conversely, at lower temperatures, a lower $CO_2$ pressure is required to maintain a given carbonation level. The relationship between temperature and pressure is approximately linear. FIG. 1 shows a typical relationship between gas pressure and water temperature for a carbonation level of 5.25. In practice, the relationship between gas pressure and water temperature may depart from the graph of FIG. 1 for various reasons such as losses in the system.

Typically, when water temperature is at 68° F., 100 ml. of water can dissolve 90 ml. of $CO_2$ gas when the gas is under one atmosphere of pressure. If the $CO_2$ is pressurized to 5.25 atmospheres or 11.175 PSIG, then 5.25 times as much $CO_2$ will dissolve in the water at the same temperature. That is, 418.5 ml. of $CO_2$ (measured at one atmosphere) will dissolve in 100 ml. of water, when the pressure is raised to 5.25 atmospheres. The solubility of $CO_2$ decreases with increasing water temperature, requiring a still higher pressure to force the same amount of $CO_2$ into solution.

Figure 2:
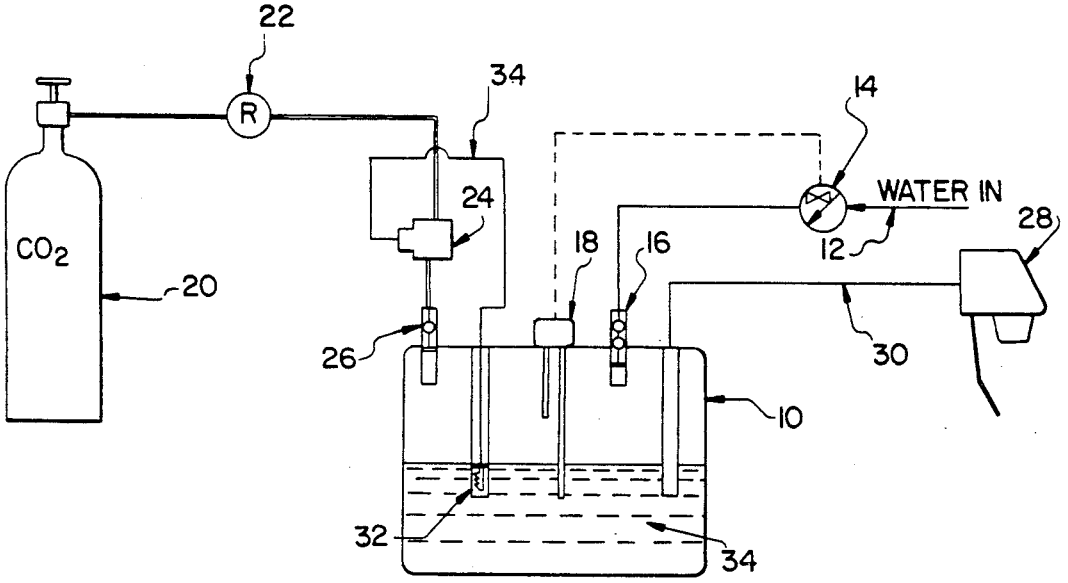
FIG. 2 is a schematic diagram of a beverage dispenser in accordance with a first embodiment of the invention, wherein a $CO_2$ pressure regulator is mechanically controlled in response to the temperature of the liquid in a carbonation tank.

The apparatus of FIG. 2 makes it possible to maintain any desired carbonation level in the carbonated water in carbonation tank 10. Water, from a water supply line 12, is supplied to tank 10 through a motor-driven pump 14 and a check valve 16. The check valve is required to maintain $CO_2$ pressure in tank 10. A double check valve is preferably used in order to insure against flow of liquid or gas back to the water supply through line 12. The motor of motor-driven pump 14 is controlled by a level sensor 18, which starts the motor when the liquid level in the tank falls below a first predetermined level, and shuts off the motor when the liquid level reaches a second predetermined level which exceeds the first predetermined level. Carbon dioxide from supply tank 20 is delivered to tank 10 through a pressure regulator 22, a temperature-controlled valve 24 and a check valve 26. Carbonated water is delivered to dispensing valve 28 through line 30.

A temperature sensor 32, immersed in the liquid 34 in tank 10, operates valve 24 through line 34, controlling the pressure regulation in the valve so that, at higher temperatures, the flow of $CO_2$ through the valve is less restricted. In the valve, a sensor bias spring (not shown in FIG. 2) controls the flow of $CO_2$ into tank 10 in such a way that the $CO_2$ pressure increases with increasing temperature in a predetermined manner to maintain a substantially constant carbonation level.

The temperature sensor 32 can be a bulb type device in which an expanding fluid flows through tube 34, to operate a diaphragm within valve 24. The expanding fluid can be a liquid such as an alcohol or glycol, or one of the several fluorocarbons available under the trademark FREON. Alternatively, the fluid can be a gas such as nitrogen or carbon dioxide.

Figure 6:
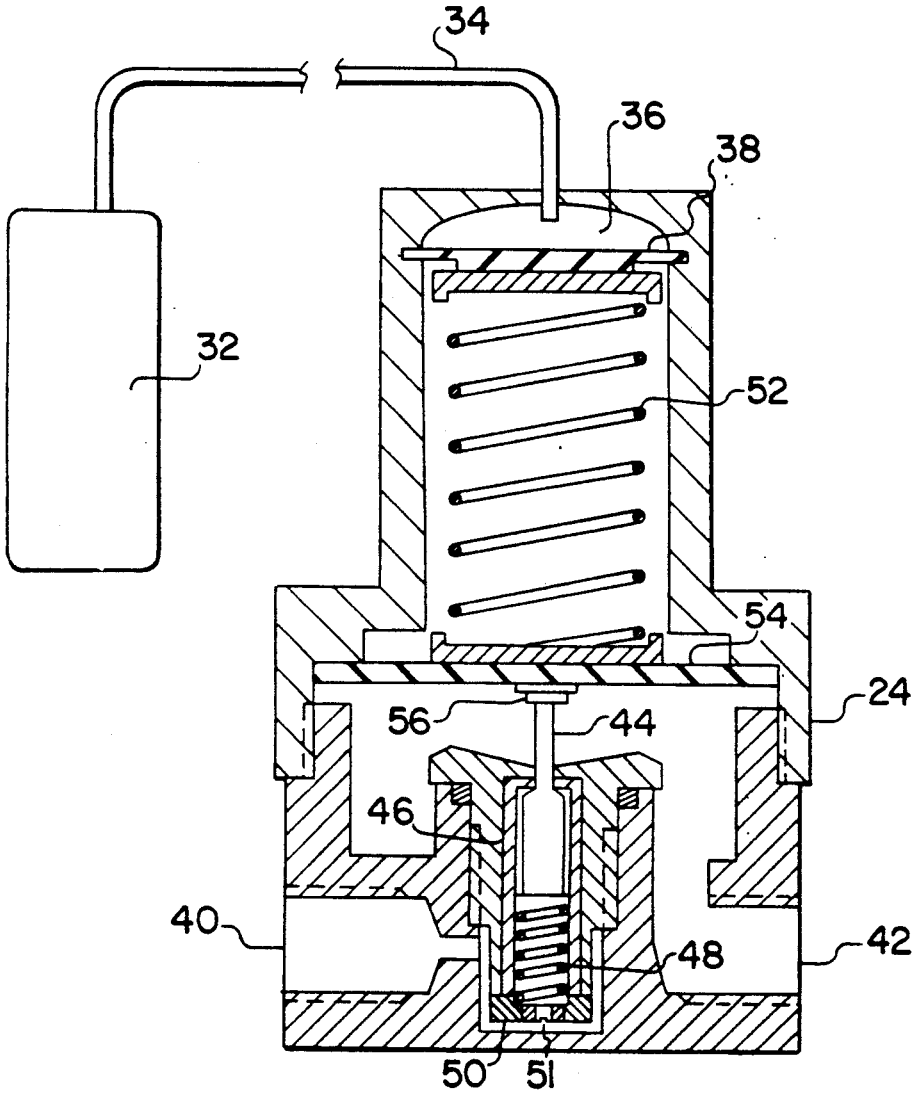
FIG. 6 is an elevational view of a temperature sensor and a first mechanically controlled $CO_2$ pressure regulation valve, the latter being shown in section.

Details of the temperature sensor 32 and valve 24 are shown in FIG. 6. Valve 24 comprises a fluid chamber 36 connected through tube 34 to sensor 32. The chamber is closed by a flexible diaphragm 38. A spring 52 (the sensor bias spring referred to above) is located between diaphragm 38 and a second diaphragm 54, which forms part of the boundary of an outlet chamber in communication with outlet 42. A valve element 44 is mechanically connected to a center rivet 56 on the bottom of diaphragm 4, and cooperates with a valve seat 46 to provide a restricted, closable passage between inlet 40 and outlet 42. Valve element 44 is urged toward its closed condition by a weak spring 48 which is in compression between the valve element and an adjustable plate 50. Plate 50 has an opening 51 allowing flow of $CO_2$ from inlet 40 toward the valve orifice. $CO_2$ flows through valve 24 from inlet 40 to outlet 42, and is controlled by the restriction between valve element 44 and valve seat 46. When pressure is reduced at outlet 42 as a result of $CO_2$ consumption, spring 52 moves diaphragm 54 downward. Rivet 56 on the bottom of the diaphragm forces valve element 44 to an open condition, allowing $CO_2$ to flow from inlet 40 to outlet 42 to restore pressure on the outlet side of valve 24, whereupon diaphragm 54 allows valve element 44 to reclose under the urging of spring 48. Spring 52 is biased by the fluid in chamber 36, acting against diaphragm 38. When the water temperature being sensed by sensor 32 is higher, the sensor fluid pressure in chamber 36 increases the downward force on spring 52. This increased downward force, in turn, produces an increased $CO_2$ pressure in the carbonator. A reduction in the temperature sensed by sensor 32 has the opposite effect, producing a decrease in the $CO_2$ pressure in the carbonator.

Figure 3:
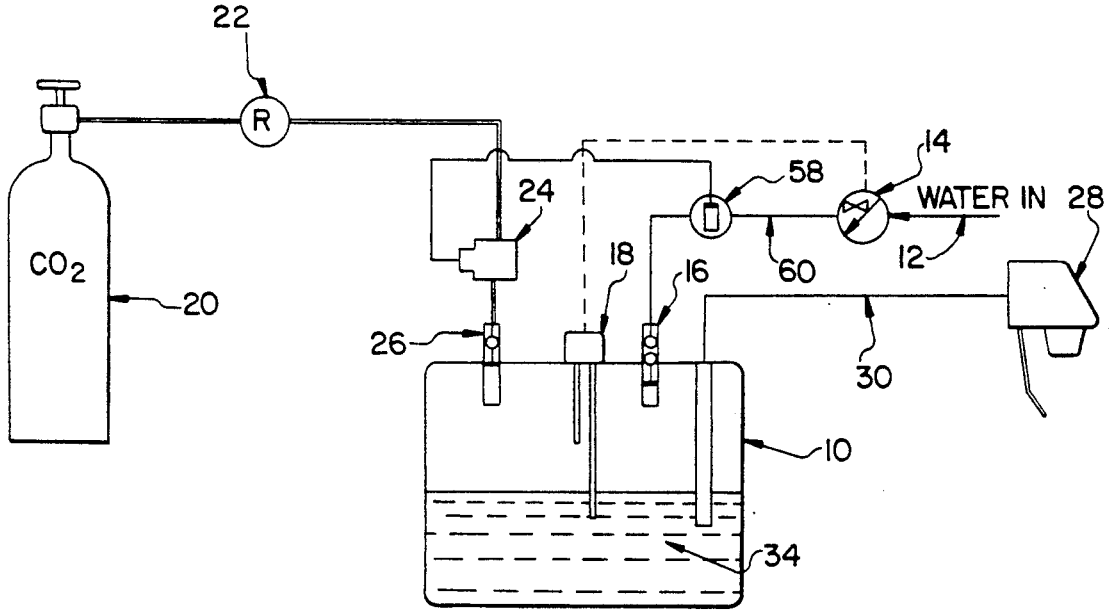
FIG. 3 is a schematic diagram of a beverage dispenser in accordance with a second embodiment of the invention, wherein a $CO_2$ pressure regulator is mechanically controlled in response to the temperature of water being fed toward a carbonation tank.

The carbonator of FIG. 3 is similar to that of FIG. 2 except that, instead of sensing the temperature of the carbonated water 34 within tank 10, it senses the temperature of the water being supplied to the tank by means of a temperature sensor 58 in line 60 between motor-driven pump 14 and double check valve 16. Temperature sensor 58 is also of the expanding fluid type. Operation of the carbonator of FIG. 3 is essentially the same as that of FIG. 2 in that $CO_2$ pressure applied to the carbonator tank is regulated in accordance with water temperature.

Figure 4:
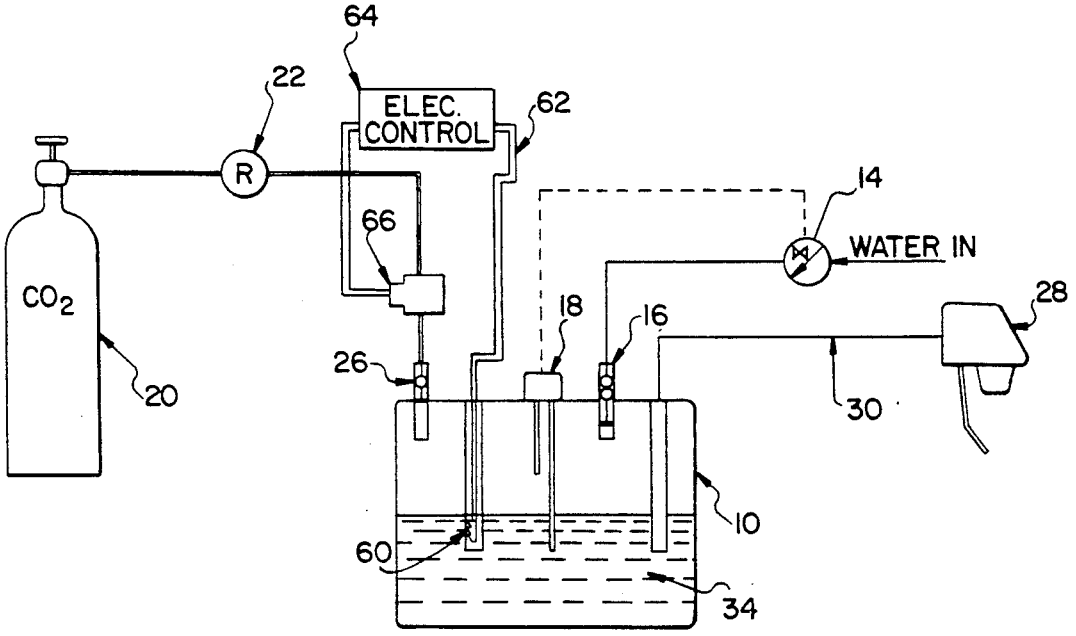
FIG. 4 is a schematic diagram of a beverage dispenser in accordance with a third embodiment of the invention, wherein a $CO_2$ pressure regulator is electronically controlled in response to the temperature of the liquid in a carbonation tank.

The carbonator of FIG. 4 uses an electrical temperature sensor 60 immersed in the carbonated water 34 in tank 10. Sensor 60 is preferably of the thermistor type. The electrical signal from the sensor is delivered through electrical lines 62 to an electronic control 64, which delivers operating current to an electrically controlled valve 66. The electronic control 64 can be any one of a variety of well-known and available servo amplifiers or other control devices capable of providing an output, the voltage or current of which has a predetermined relationship to the level of the input signal. Alternatively, the electronic control can be a more elaborate analog or digital servo controller. The essential requirement is that the output signal of the electronic controller be such the restriction in valve 66 regulates the $CO_2$ pressure in tank 10 so that it bears the desired relationship to the sensed temperature. With an electronic control, the desired relationship between temperature and pressure can be easily achieved. Furthermore, the carbonation level can be set electrically in the controller itself, instead of mechanically by adjustment of valve spring compression.

Figure 7:
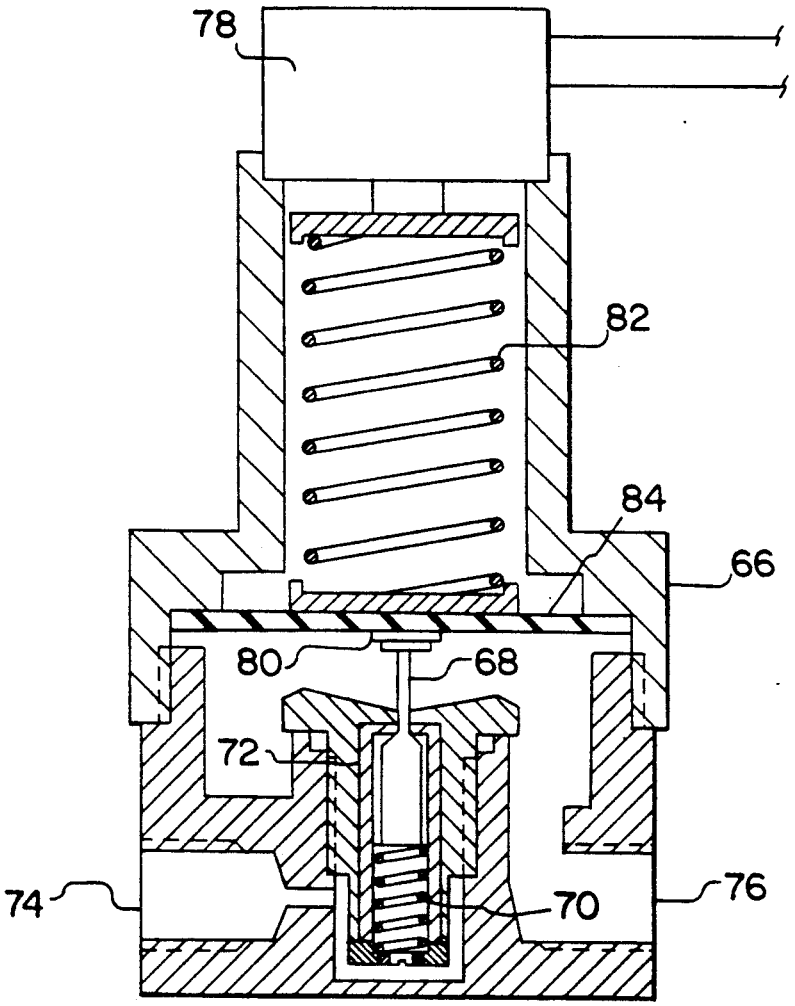
FIG. 7 is sectional view of an electronically controlled $CO_2$ pressure regulation valve.

As shown in FIG. 7, valve 66 is similar to valve 24 in that it comprises a valve element 68 urged by a coil spring 70 toward a valve seat 72. The valve provides a variable restriction for flow of $CO_2$ from inlet 74 to outlet 76. Movement of valve element 68 against the force of spring 70 is controlled by a proportioning solenoid 78, the armature of which is mechanically connected to element 68 through center rivet 80 and spring 82, which presses against diaphragm 84.

Figure 5:
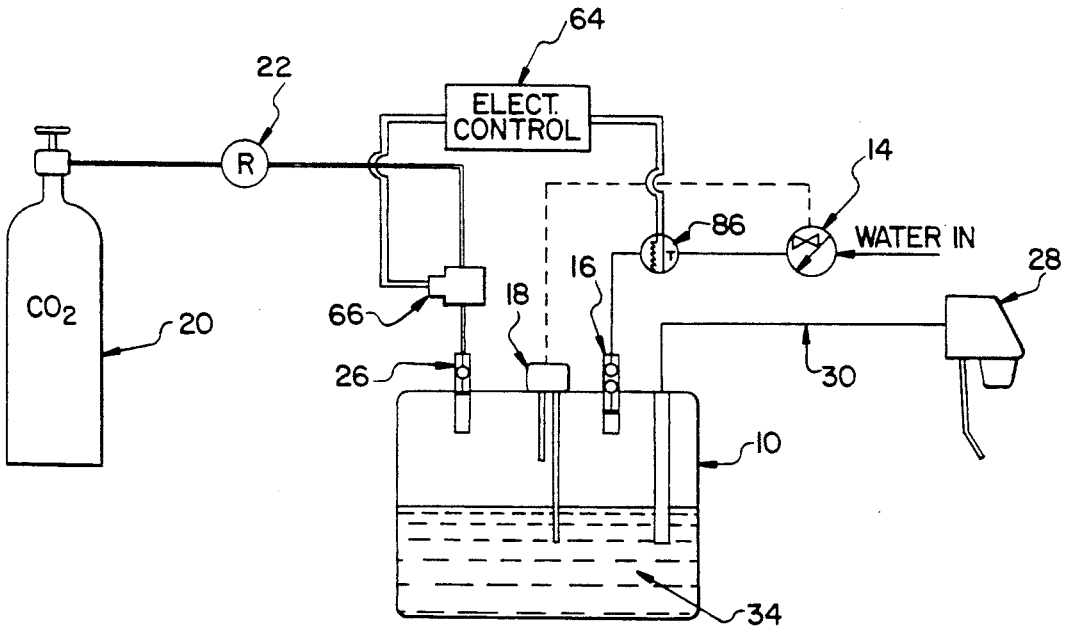
FIG. 5 is a schematic diagram of a beverage dispenser in accordance with a fourth embodiment of the invention, wherein a $CO_2$ pressure regulator is electronically controlled in response to the temperature of water being fed toward a carbonation tank.

The carbonator of FIG. 5 is similar to that of FIG. 4 except that, instead of sensing the temperature of the carbonated water 34 within tank 10, it senses the temperature of the water being supplied to the tank by means of an electronic temperature sensor 86 in line 88 between motor-driven pump 14 and double check valve 16. Temperature sensor 86 is preferably of the thermistor type. Operation of the carbonator of FIG. 5 is essentially the same as that of FIG. 4 in that $CO_2$ pressure applied to the carbonator tank is regulated in accordance with water temperature.

Figure 8:
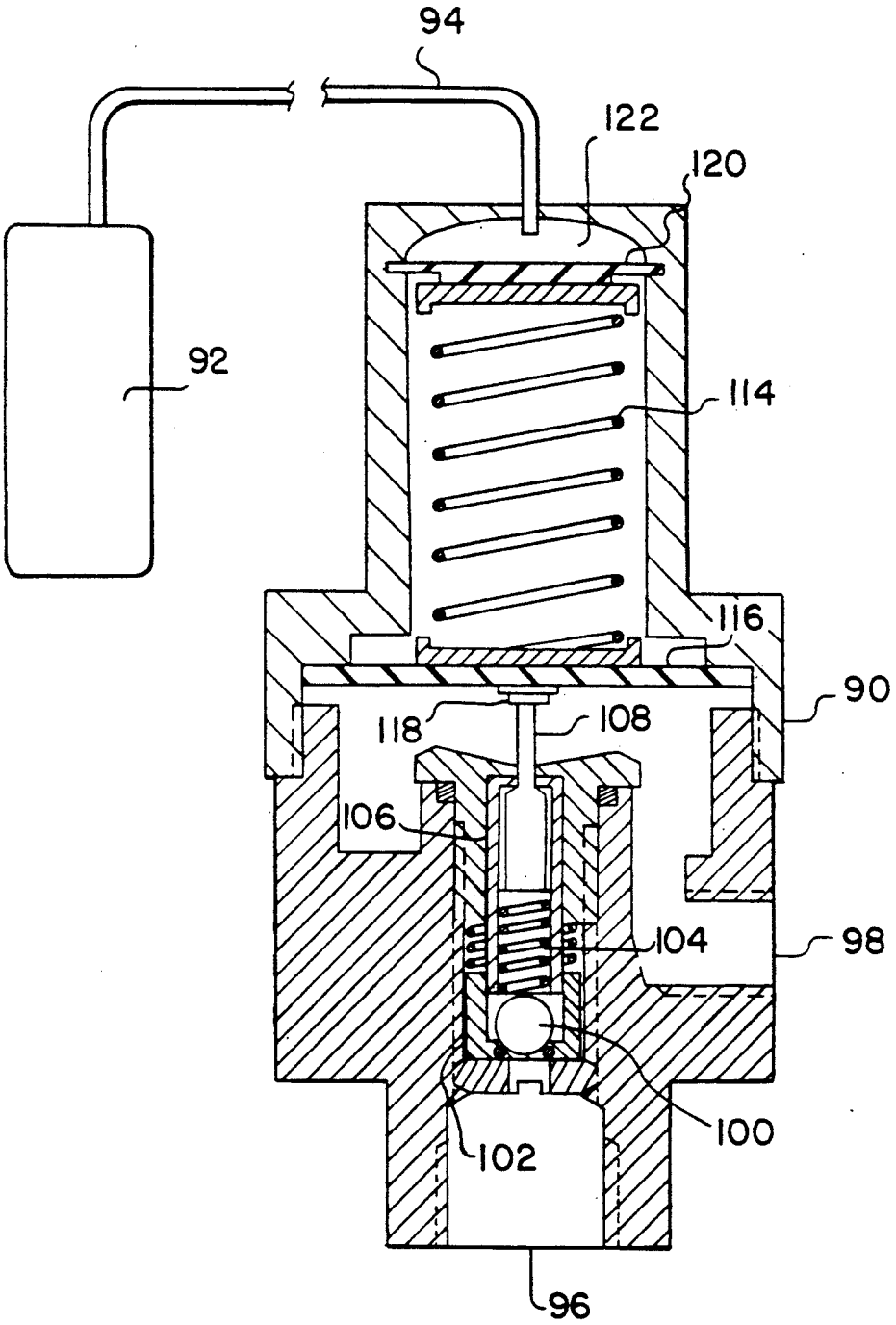
FIG. 8 is a sectional view of an alternative mechanically controlled valve.

The valve of FIG. 8 takes the place of temperature-controlled valve 24 and check valve 26 in FIG. 2. The structure of the valve is similar to that of the valve of FIG. 6, except that the valve includes a check ball arranged to prevent reverse flow of $CO_2$. As shown in FIG. 8, valve 90 is controlled by fluid flowing to and from sensor 92 through tube 94. The valve comprises a $CO_2$ inlet 96, and a $CO_2$ outlet 98, the inlet being connectable to the gas supply, and the outlet being connected to the carbonator tank. The inlet is normally closed by a check valve comprising a ball 100 urged against a seat 102 by a small spring 104. Spring 104 is held in the chamber containing seating element 106, and is trapped between valve element 108 and check ball 100. Spring 104 is weaker than spring 114, and allows both the check ball 100 and valve element 108 to be open simultaneously. This allows flow of $CO_2$ through the valve from inlet 96 toward outlet 98 when increased force applied to spring 114 causes diaphragm 116 to press against center rivet 118, forcing valve element 118 open.

Figure 9:
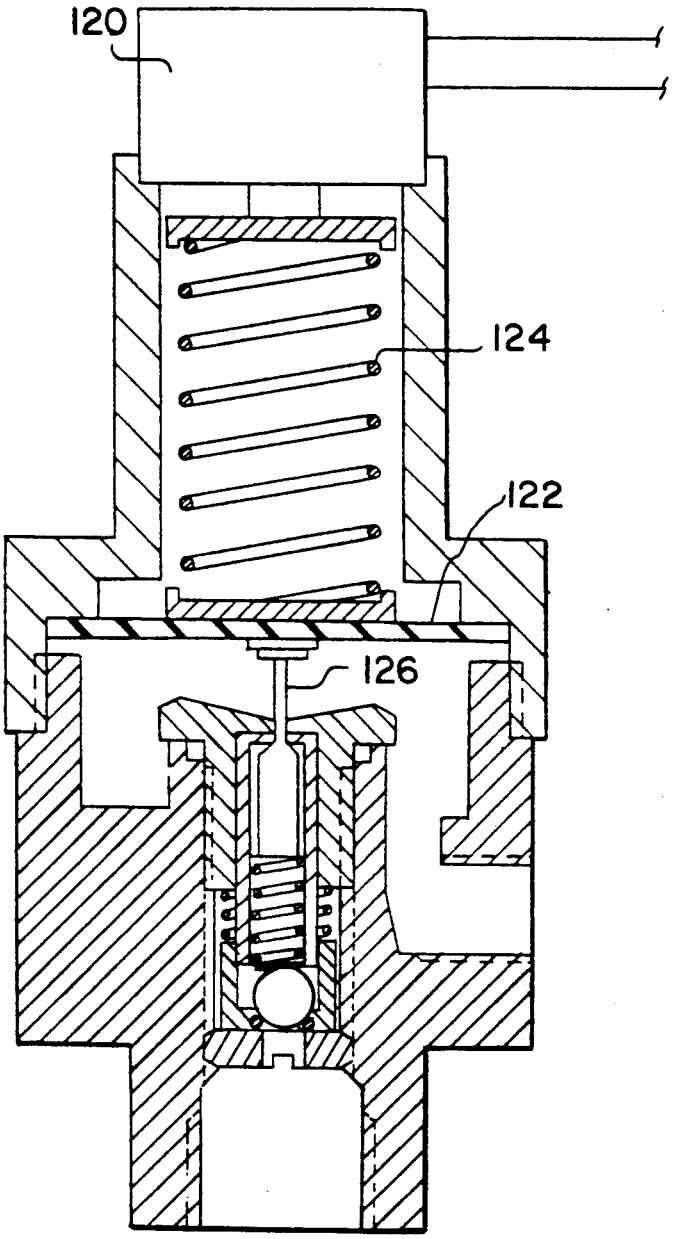
FIG. 9 is a sectional view of an alternative electrically controlled valve.

The electrically controlled valve of FIG. 9 is similar to the valve of FIG. 8, except that it uses a proportional solenoid 120 to press downward on diaphragm 122 through spring 124, to open valve element 126.

Various modifications can be made to the carbonators described. For example, while expanding fluid sensors 32, 58 and 92 are shown in FIGS. 2, 3 and 7 respectively, it is possible to use other means, including solid mechanical linkages for example, to connect the temperature sensor to the pressure regulating valve. The desired relationship between temperature and pressure in the regulation valve can be achieved in various ways, such as by choosing appropriate shapes for the valve element and valve seat, or by using special mechanical linkages between the valve element and the diaphragm. The $CO_2$ check valve and the incoming water check valve can be integrated in a single housing along with a temperature-responsive valve in the $CO_2$ path and a temperature sensor in the water path. Another cost-effective variation of the device is a simple, electronically actuated shut-off valve which is triggered open and closed by a microprocessor circuitry responsive to pressure and temperature transducers within the carbonator tank. These and other modifications can, of course, be made without departing from the scope of the invention as defined in the following claims.

We claim:

1. In a post-mix beverage dispensing system having a carbonator apparatus for introducing carbon dioxide gas into water, the improvement comprising:

a carbonation tank and a supply line for conducting water into said tank, temperature sensing means arranged to sense the temperature of the water within said supply line; and control means responsive to said temperature sensing means for controlling the pressure at which said gas is introduced into the water, the pressure varying with the water temperature according to a predetermined substantially linear function for producing a substantially constant carbonation level in the water.

2. In a post-mix beverage dispensing system having a carbonator apparatus for introducing carbon dioxide gas into water, the improvement comprising:

a carbonation tank and a supply line for conducting water into said tank;

temperature sensing means arranged to sense the temperature of the water within said supply line; and control means responsive to said temperature sensing means for controlling the pressure at which said gas is introduced into the water, the pressure varying with the water temperature according to a predetermined substantially linear function for producing a preselected, substantially constant carbonation level in the water.

3. In a post-mix beverage dispensing system having a carbonator apparatus for introducing carbon dioxide gas into water, the improvement comprising:

temperature sensing means arranged to sense the temperature of the water; and control means responsive to said temperature sensing means for controlling the pressure at which said gas is introduced into the water, the pressure varying with the water temperature according to a predetermined substantially linear function for producing a substantially constant carbonation level in the water, said control means comprising:

valve means for regulating the flow of said gas to the water;

diaphragm means operatively connected to said valve means with one side exposed to the pressure at which said gas is introduced to said liquid; and bias means operatively connected between said temperature sensing means and the other side of said diaphragm means for opposing said pressure.

4. A carbonator according to claim 3 including means for adjusting the resistance of said bias means.

5. In a post-mix beverage dispensing system having a carbonator apparatus for introducing carbon dioxide gas into water, the improvement comprising:

temperature sensing means arranged to sense the temperature of the water; and control means responsive to said temperature sensing means for controlling the pressure at which said gas is introduced into the water, the pressure varying with the water temperature according to a predetermined substantially linear function for producing a preselected, substantially constant carbonation level in the water, said control means comprising:

valve means for regulating the flow of said gas to the water;

diaphragm means operatively connected to said valve means with one side exposed to the pressure at which said gas is introduced to said liquid; and bias means operatively connected between said temperature sensing means and the other side of said diaphragm means for opposing said pressure.

6. A carbonator according to claim 5 including means for adjusting the resistance of said bias means.

7. In a post-mix beverage dispensing system having a carbonator apparatus for introducing carbon dioxide gas into water, the improvement comprising:

temperature sensing means arranged to sense the temperature of the water;

control means responsive to said temperature sensing means for controlling the pressure at which said gas is introduced into the water, the pressure varying with the water temperature according to a predetermined substantially linear function for maintaining a substantially constant carbonation level in the water, said control means further comprising:

an inlet;

an outlet;

a flow path between said inlet and said outlet;

a valve seat located in said flow path;

a valve element arranged to cooperate with said seat;

a movable diaphragm operatively connected to said valve element and having one side exposed to fluid pressure at said outlet;

means located between said diaphragm and said valve element for urging said valve element away from said seat and toward its open condition when said diaphragm moves in response to a decrease in fluid pressure at said outlet;

first spring means urging said valve element toward said seat;

means movable in response to said temperature sensing means; and second spring means located between said movable means and said diaphragm for transmitting a force from said movable means to said diaphragm according to said predetermined function;

whereby the pressure at said outlet is regulated in response to movement of said diaphragm, and movement of said diaphragm is influenced both by pressure at said outlet and by the temperature sensed by said temperature sensing means.

8. A carbonator according to claim 7 including check valve means located in said inlet for preventing flow from said outlet toward said inlet.

9. A carbonator according to claim 7 in which said means movable in response to said temperature sensing means is a second diaphragm.

10. A carbonator according to claim 7 in which said means movable in response to said temperature sensing means is an electrically operated proportional solenoid.

11. A carbonator according to claim 7 including means for adjusting the stress on said first spring.

* * * * *